US008249479B2

(12) United States Patent
Furuya et al.

(10) Patent No.: US 8,249,479 B2
(45) Date of Patent: Aug. 21, 2012

(54) APPARATUS AND METHOD OF CONTROLLING AN IMAGE FORMING APPARATUS

(75) Inventors: Nobuyuki Furuya, Ibaraki (JP); Takeshi Uchida, Ibaraki (JP)

(73) Assignee: Ricoh Company Limited, Tokyo (JP)

( * ) Notice: Subject to any disclaimer, the term of this patent is extended or adjusted under 35 U.S.C. 154(b) by 273 days.

(21) Appl. No.: 12/796,156

(22) Filed: Jun. 8, 2010

(65) Prior Publication Data

US 2010/0316403 A1 Dec. 16, 2010

(30) Foreign Application Priority Data

Jun. 12, 2009 (JP) ..... 2009-141549

(51) Int. Cl.
*G03G 15/20* (2006.01)
*G03G 15/00* (2006.01)

(52) U.S. Cl. ..... 399/67; 399/68; 399/69; 399/407; 399/408

(58) Field of Classification Search ..... 270/37, 270/58.09; 399/67–69, 407–410
See application file for complete search history.

(56) References Cited

U.S. PATENT DOCUMENTS 7,941,089 B2 * 5/2011 Mori et al. ..... 399/408

FOREIGN PATENT DOCUMENTS

| | | |
|---|---|---|
| JP | 2006-116868 | 5/2006 |
| JP | 3875802 | 11/2006 |
| JP | 2007-84324 | 4/2007 |
| JP | 2008-37610 | 2/2008 |
| JP | 2008-132728 | 6/2008 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus is controlled such that the amount of heat supplied to an outer surface recording sheet to be placed onto an outer surface of a book document for fixing a toner image thereon is greater than an amount of heat supplied to each of the other recording sheets to be placed onto an inner side of the book document for fixing a toner image thereon.

20 Claims, 8 Drawing Sheets

APPARATUS AND METHOD OF CONTROLLING AN IMAGE FORMING APPARATUS

CROSS-REFERENCE TO RELATED APPLICATIONS

This patent application is based on and claims priority under 35 U.S.C. §119 to Japanese Patent Application No. 2009-141549, filed on Jun. 12, 2009, in the Japanese Patent Office, the entire disclosure of which is hereby incorporated herein by reference.

FIELD OF THE INVENTION

The present invention generally relates to an apparatus, system, and method of controlling an image forming apparatus, and more specifically to an apparatus, system, and method of controlling an image forming apparatus that outputs a plurality of recording sheets to be bundled to create a book document.

BACKGROUND

An image forming system may be provided that includes an image forming apparatus capable of forming an image on a recording sheet such as a copier or a printer, and a post-processing apparatus capable of applying post-processing to the recording sheet having the image formed thereon. For example, the post-processing apparatus may bind a plurality of recording sheets output from the image forming apparatus to generate a book document. Recently, the post-processing apparatus is provided with a wide variety of functions to create a book document, such as the function of saddle-stitching as described in Japanese Patent Application Registration No. 3875802 or paperback binding as described in Japanese Patent Application Publication No. 2008-132728.

In the image forming apparatus, a transfer device transfers the recording sheet having a toner image formed thereon through a fixing device. The fixing device fixes the toner image onto the recording sheet by heat and pressure. In order to sufficiently fix the toner image onto the recording sheet, a temperature of the recording sheet having the toner image thereon needs to be sufficiently increased so as to cause toner in the toner image to melt. This may be achieved by either increasing a fixing temperature of the fixing device or by reducing a transfer speed at which the recording sheet is transferred through the fixing device. However, a higher fixing temperature may result in degradation in image quality such that a desired level of gloss or color may not be obtained. Further, the reduced transfer speed of the recording sheet may reduce the overall processing speed to compete printing operation. For this reason, the fixing device fixes the toner image onto the recording sheet with the lowest fixing temperature that sufficiently fixes the toner image. Further, the transfer device transfers the recording sheet with the highest transfer speed that sufficiently fixes the toner image. This may sometimes cause the toner image to be partially removed especially when the recording sheet is folded by the post-processing apparatus. In case of creating a book document, the book document that is created may not be of good quality if the toner image is partially removed from the recording sheet, which is to be placed on the outer surface of the book document.

In view of the above, Japanese Patent Application Publication No. 2007-084324 discloses a sheet processor provided with a heating roller pair that heats the bound part of a bundle of sheets such that toner fixed onto the bound part is melted. While this technique is able to prevent toner from being partially removed from the recording sheet, the heating roller pair needs to be additionally installed onto the sheet processor, thus increasing a size of the sheet processor and increasing the overall manufacturing cost for the sheet processor.

There is a need for an apparatus, method, or system capable of preventing toner in the fixed toner image from being partially removed from the recording sheet even when the recording sheet having the fixed toner image is folded to create a book document, while keeping down the overall size and the manufacturing cost of the post-processing apparatus or the image forming apparatus.

SUMMARY

Example embodiments of the present invention include an apparatus, method, system, computer program, and product each capable of controlling an image forming apparatus such that the amount of heat supplied to an outer surface recording sheet to be placed onto an outer surface of a book document for fixing a toner image thereon is greater than an amount of heat supplied to each of the other recording sheets to be placed onto an inner side of the book document for fixing a toner image thereon.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
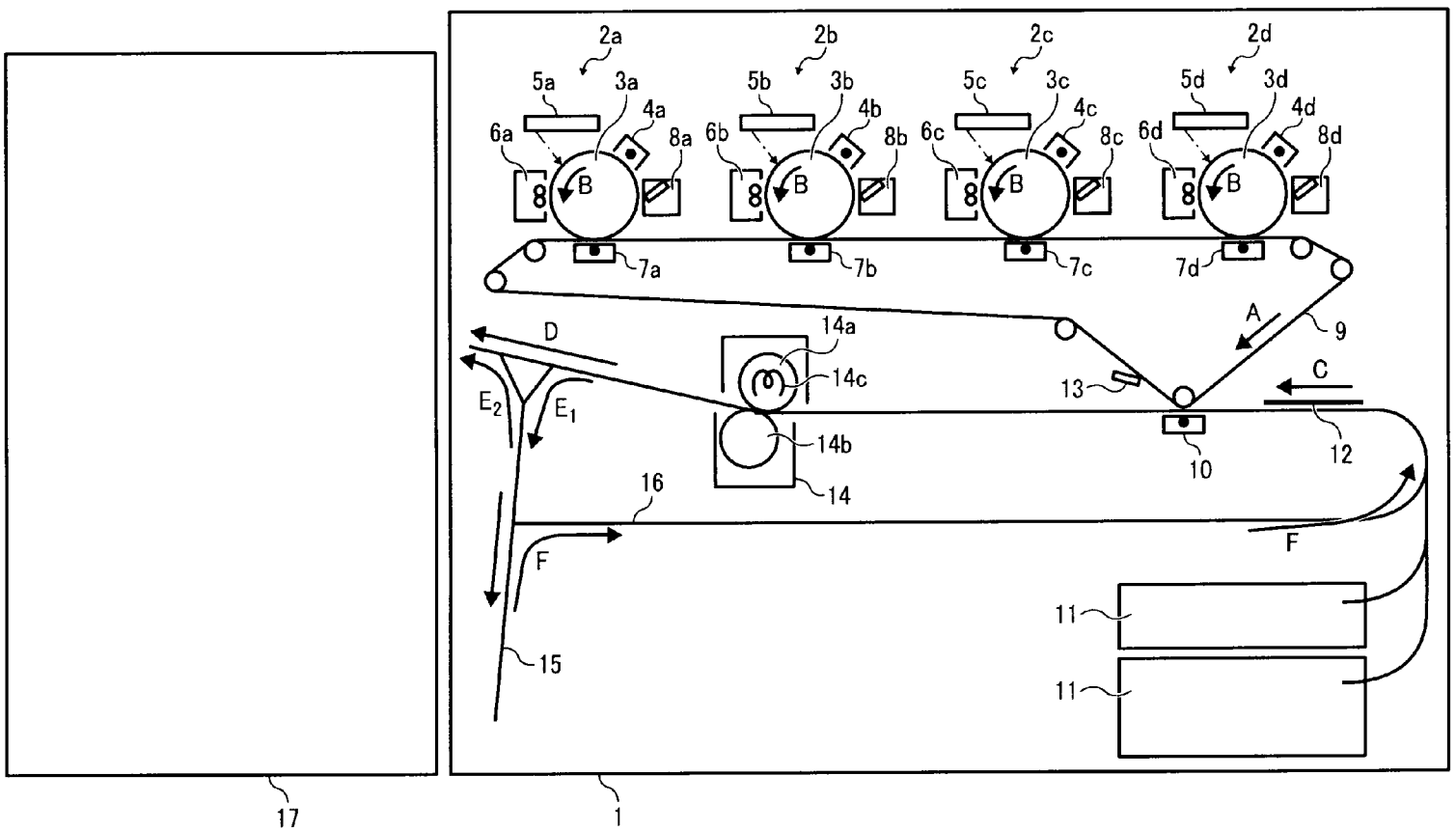
FIG. 1 is a schematic block diagram illustrating a cross-sectional view of an image forming system including an image forming apparatus connected to a post-processing apparatus, according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Figure 2:
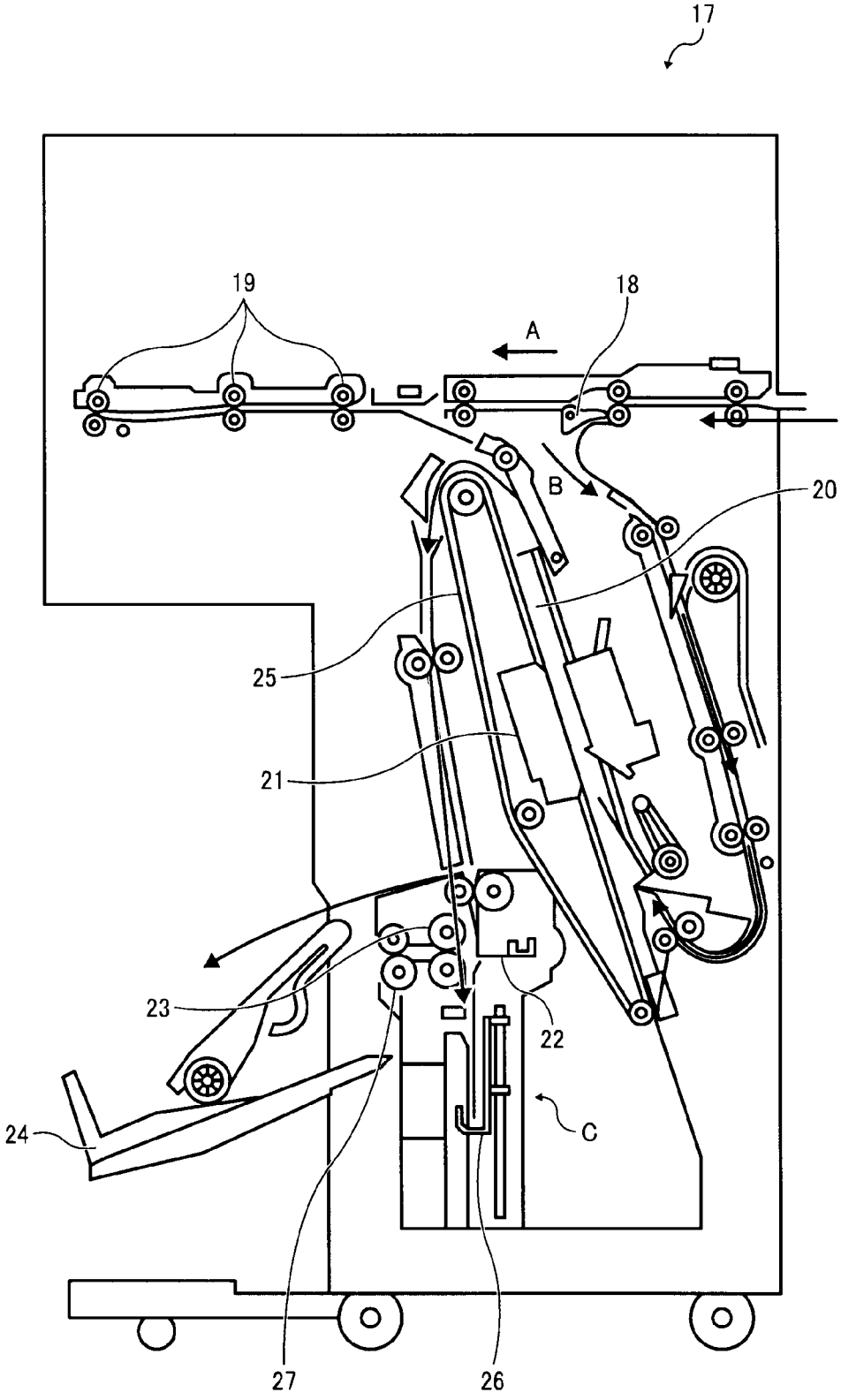
FIG. 2 is a schematic block diagram illustrating a cross-sectional view of the post-processing apparatus of FIG. 1.

Referring now to FIGS. 1 and 2, an image forming system including an image forming apparatus 1 and a post-processing apparatus 17 is explained according to an example embodiment of the present invention.

Referring to FIG. 1, the image forming apparatus 1, which may be implemented by a printer, includes four image forming units 2*a*, 2*b*, 2*c*, and 2*d*, which are arranged along a conveyance direction of a transfer belt 9. The image forming unit 2*a* includes a photoconductive drum 3*a* that functions as an image carrier, a charger device 4*a* of drum-like shape, an exposure device 5*a*, a developing device 6*a*, a primary transfer device 7*a*, and a cleaning device 8*a*. The image forming units 2*b*, 2*c*, and 2*d* have substantially similar in structure and function to the image forming unit 2*a*, except for the color of the image being formed or the color of toner stored in the developing device. In this example, the image forming units 2*a*, 2*b*, 2*c* and 2*d* respectively form the images of yellow, magenta, cyan, and black.

When an image forming start signal is received from a controller 110 (FIG. 10) of the image forming apparatus 1, the photoconductive drum 3*a* starts rotating in the direction indicated by arrow B, and keeps rotating at least until the image forming operation completes for the image forming unit 2*a*.

As the photoconductive drum 3*a* starts to rotate, the charger device 4*a* is supplied with high electric voltage to uniformly charge the surface of the photoconductive drum 3*a* with a negative electric charge. The controller 100 of the image forming apparatus 1 sends an on/off signal of the exposure device 5*a* according to character data or picture data to form a dot image, or a latent image, on the surface of the photoconductive drum 3*a*. More specifically, based on the on/off signal of the exposure device 5*a*, the surface of the photoconductive drum 3*a* has an area that receives the laser beam irradiated from the exposure device 5*a* and an area that does not receive the laser beam irradiated from the exposure device 5*a*. The area that receives the laser beam from the exposure device 5*a* has the electric charge having a lower value. As this area with the lowered electric charge reaches a position that faces the developing device 6*a*, this area with the lowered electric charge attracts toner having a negative charge to form the toner image on that area.

When the toner image formed on the surface of the photoconductive drum 3*a* reaches a position that faces the primary transfer device 7*a*, the toner image is transferred onto the transfer belt 9 that rotates in the direction indicated by the arrow A. The rotation of the transfer belt 9 is caused due to a high electric voltage supplied by an electric power source to the primary transfer device 7*a*. The residual toner that resides on the surface of the photoconductive drum 3*a* after transferring of the toner image is removed by the cleaning device 8*a* to prepare for another image forming operation.

Figure 10:
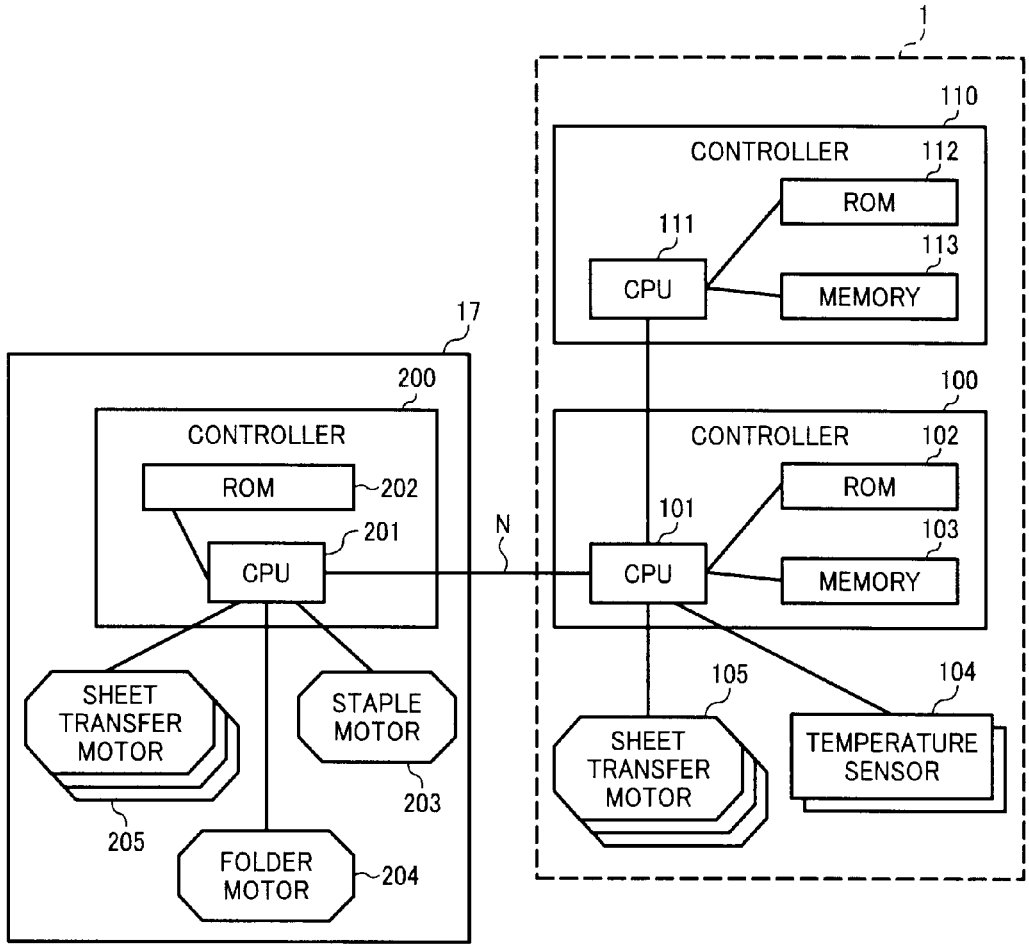
FIG. 10 is a schematic block diagram illustrating a selected portion of the image forming system of FIG. 1.

In a substantially similar manner as described above for the case of forming the yellow toner image by the image forming unit 2*a*, the image forming unit 2*b* performs image forming operation to form the magenta toner image on the photoconductive drum 3*b*. The toner image is then transferred onto the transfer belt 9 due to a high electric voltage applied to the primary transfer device 7*b*. The image forming apparatus 1 is provided with a controller 100 as illustrated in FIG. 10. The controller 100 of the image forming apparatus 1 controls a transfer speed of the transfer belt 9 such that the toner image formed by the image forming unit 2*a* and transferred onto the transfer belt 9 reaches the primary transfer unit 7*b* at a predetermined time to meet the time at which the toner image formed on the photoconductive drum 3*b* is transferred onto the transfer belt 9. In this manner, the toner image formed by the image forming unit 2*b* is superimposed on the toner image transferred to the transfer belt 9 from the image forming unit 2*a*. In a substantially similar manner, the cyan toner image formed by the image forming unit 2*c* and the black toner image formed by the image forming unit 2*d* are transferred to the transfer belt 9 to be superimposed one above the other, thus forming a full-color image on the transfer belt 9.

At a predetermined time at which the full-color image formed on the transfer belt 9 reaches a position facing a secondary transfer device 10, which is a secondary transfer nip, a recording sheet 12 functioning as a recording medium, which is transferred from a sheet feeding device 11 in the direction indicated by the arrow C, reaches a position at which the secondary transfer device 10 is provided. Along a transfer sheet path from the sheet feeding device 11 to the fixing device 14, a plurality of rollers are provided such as a registration roller that are rotated to carry the recording sheet along the transfer sheet path. The full-color image formed on the transfer belt 9 is transferred onto one side of the recording sheet 12 at the secondary transfer nip due to a high electric voltage applied to the secondary transfer device 10. The recording sheet 12 having the full-color image, which is unfixed, formed thereon is transferred to a fixing device 14.

The fixing device 14 includes a fixing roller 14*a*, and a pressure roller 14*b* that presses against the fixing roller 14*a*. The fixing roller 14*a* and the pressure roller 14*b* are made in close contact with each other to together form a fixing nip therebetween. As the recording sheet 12 is transferred through the fixing nip, the recording sheet 12 is pressed by pressure caused by the fixing roller 14*a* and the pressure roller 14*b*. The fixing roller 14*a* includes a heat source 14*c* in its inside. With the heat generated by the heat source 14*c*, the fixing roller 14*a* is heated. The heated fixing roller 14*a* heats the recording sheet as the recording sheet is transferred through the fixing nip. With this heat and the pressure at the fixing nip, the full-color image is fixed onto the recordings sheet.

After the full-color image is transferred to the recording sheet at the secondary transfer nip where the secondary transfer device 10 is provided, the transfer belt 9 may still have residual toner that has not been transferred to the recording sheet 12. The residual toner is removed by a belt cleaning device 13 that is provided downstream in a belt transfer direction.

In this example, the rotational speed of the photoconductive drum 3 or the transfer belt 9, or the transfer speed of the recording sheet, is a linear speed that is previously determined specific to the image forming apparatus 1. The linear speed may be expressed in a unit distance per second such as in mm/sec.

The recording sheet 12 that exits the fixing device 14 may be transferred through different paths depending on different image forming or discharge modes. In case of single-side printing mode of forming an image on one side of the recording sheet, in one example, the recording sheet may be discharged such that the side having the image faces upside ("face-up discharge mode"). In another example, the recording sheet may be discharged such that the side having the image faces downside ("face-down discharge mode"). In case of the face-up discharge mode, the recording sheet 12 that exits the fixing device 14 is directly transferred toward the post-processing apparatus 17 as indicated by the arrow A. In case of the face-down discharge mode, the recording sheet 12 that is output from the fixing device 14 is sent toward a switch back device 15 as indicated by the arrow E1. After the side of the recording sheet 12 is reversed at the switch back device 15, the recording sheet 12 is transferred toward the post-processing apparatus 17 as indicated by the arrow E2.

In case of double-sided printing mode of forming an image on both sides of the recording sheet, the recording sheet 12 that exits the fixing device 14 is sent back to the secondary transfer device 10 through the switch back device 15 and a duplex transfer path 16 as indicated by the arrow F. After the full-color image is formed on the other side of the recoding sheet 12 at which the secondary transfer device 10 is provided, the recording sheet 12 is transferred to the fixing device 14. As described above, the recording sheet 12 that exits the fixing device 14 may be transferred through different paths depending on different discharge modes. The recording sheet may be discharged such that the side having the first image faces upside in the face-up discharge mode. The recording sheet may be discharged such that the side having the first image faces downside in the face-down discharge mode, after being reversed by the switch back device 15.

In the above-described example, the printing speed of the image forming apparatus 1 may be obtained based on a number of images that are formed on the photoconductive drum 3 for a predetermined time period or a number of recording sheets 12 that is fed from the sheet feeding device 11 for a predetermined time period. The printing speed may be generally expressed in page per minute (ppm).

Referring now to FIG. 2, the post-processing apparatus 17 is explained according to an example embodiment of the present invention. The post-processing apparatus 17 is provided with a function of creating a book document by folding a bundle of a plurality of recording sheets, for example, by saddle-stitching or paperback binding.

The post-processing apparatus 17, which is connected to the image forming apparatus 1, receives the recording sheets, one by one, as the recording sheets are output from the image forming apparatus 1. For the illustrative purpose, in this example, it is assumed that the recording sheet is discharged in the upside discharge mode. More specifically, in the case of single-side printing, the recording sheet having the first image formed thereon is discharged while having the side having the image that faces upside. In the case of double-side printing, the side of the recording sheet having the second image thereon faces upside.

Figure 3:
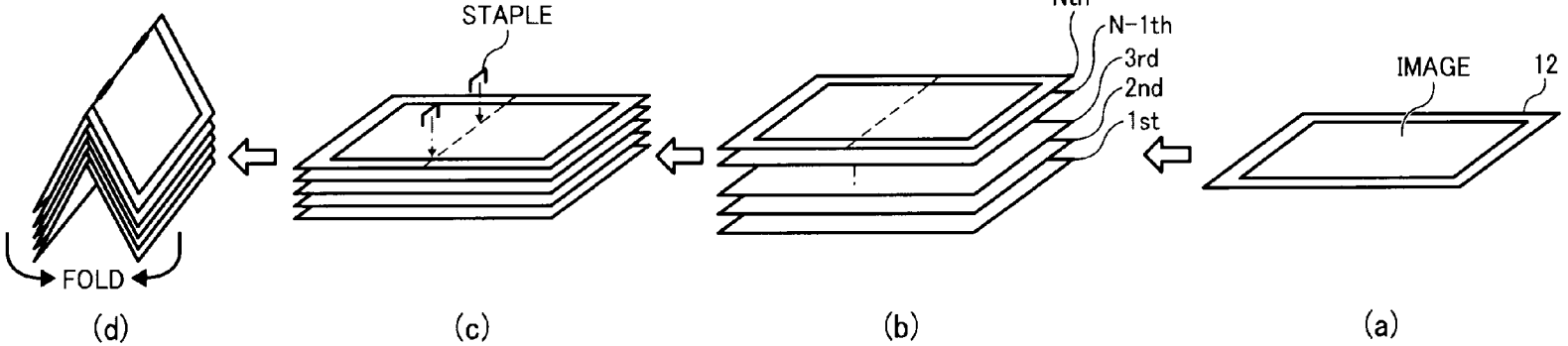
FIG. 3 is an illustration for explaining operation of creating a book document by saddle-stitching.

The recording sheet 12 transferred to the post-processing apparatus 17 from the image forming apparatus 1 is transferred toward either a transfer path A or a transfer path B, depending on the position of a switch pawl 18. The recording sheet 12 transferred to the transfer path A is transferred by a plurality of discharge roller pairs 19, and discharged onto a discharge tray. The recording sheet 12 transferred to the transfer path B is transferred to a staple tray 20, for example, as illustrated in FIG. 3(*a*). The recording sheet 12 is kept in the staple tray 20 until a predetermined number of recording sheet 12 are stacked on the staple tray 20. As illustrated in FIG. 3(*b*), the predetermined number of recording sheets 12 that will be made into one book document are stacked in a predetermined order onto the staple tray 20. The staple tray 20 is provided with an adjustment roller and a jogger fence. As the recording sheets 12 are mounted on the staple tray 20, the adjustment roller adjusts the position of each recording sheet 12 in the longer-length sheet direction, or the sheet transfer direction, of the recording sheet 12. The jogger fence adjusts the position of each recording sheet 12 in the shorter-length sheet direction of the recording sheet 12. As illustrated in FIG. 3(*c*), a stapler 21 staples a center section of the recording sheets 12 to create a sheet bundle.

As the sheet bundle is transferred to a folder device C, a leading edge of the sheet bundle is made in contact with a movable fence 26 and stops at the movable fence 26. In this example, the movable fence 26 moves to a position based on the size of the recording sheet 12 of the sheet bundle such that the center section of the sheet bundle that is stopped is kept at the position where a folder plate 22 is provided. As the folder plate 22 moves toward the sheet bundle, the center section of the sheet bundle is pressed in the direction substantially perpendicular to the sheet transfer direction, thus causing the center section of the sheet bundle to move toward a nip formed by a folder roller pair 23. The folder roller pair 23 transfers the sheet bundle toward a discharge roller pair 27 while applying pressure to the sheet bundle, thus creating the book document as illustrated in FIG. 3(*d*). The book document is discharged onto a book document tray 24.

FIG. 10 illustrates a selected portion of the image forming apparatus 1 and the post-processing apparatus 17. The image forming apparatus 1 includes the controller 100, a sheet transfer motor 105 including one or more sheet transfer motors, a temperature sensor 104 including one or more temperature sensors. The controller 100 includes a central processing unit (CPU) 101, a read only memory (ROM) 102 that is an non-volatile read only memory, and a memory 103 that is an non-volatile writable memory. The post-processing apparatus 17 includes a controller 200, a staple motor 203 including one or more staple motors, a folder motor 204 including one or more folder motors, and a sheet transfer motor 205 including one or more sheet transfer motors. The controller 200 includes a central processing unit (CPU) 201, and a read only memory (ROM) 202 that is an non-volatile read only memory. Further, the image forming apparatus 1 is provided with the controller 110 functioning as a printer controller. The controller 110 includes a CPU 111, a ROM 112 that is an non-volatile read only memory, and a memory 113 that is an non-volatile writable memory. The CPU 111 of the controller 110 and the CPU 101 of the controller 100 communicate with each other.

In this example, an image forming control program is stored in a memory such as the ROM 102. According to the image forming control program, the CPU 101 controls image forming operation performed by the image forming apparatus 1. For example, the CPU 101 controls a fixing temperature of the fixing device 14 according to information regarding a fixing temperature detected by the temperature sensor 104 and information regarding a target fixing temperature that may be stored in a memory such as the memory 103. In another example, the CPU 101 may control a transfer speed of the recording sheet through controlling the sheet transfer motor 105 that drives a transfer device such as the plurality of rollers provided along the path from the sheet feeding device 11 and information regarding a target transfer speed that may be stored in a memory such as the memory 103.

Further, the CPU 101 of the image forming apparatus 1 controls operation of the post-processing apparatus 17 by communicating with the CPU 201 of the post-processing apparatus 17 via a network N. In one example, under control of the CPU 101, the CPU 201 of the post-processing apparatus 17 performs stapling by driving a stapler device such as the stapler 21 through the staple motor 203. In another example, under control of the CPU 101, the CPU 201 of the post-processing apparatus 17 performs folding by driving a folder device such as the folder plate 22 and the folder roller pair 23 through the folder motor 204. Under control of the CPU 101, the CPU 201 of the post-processing apparatus 17 controls the sheet transfer motor 205 to transfer the recording sheet in the post-processing apparatus 17. In this example, the network N may be implemented by any desired type of wired or wireless network.

Figure 4:
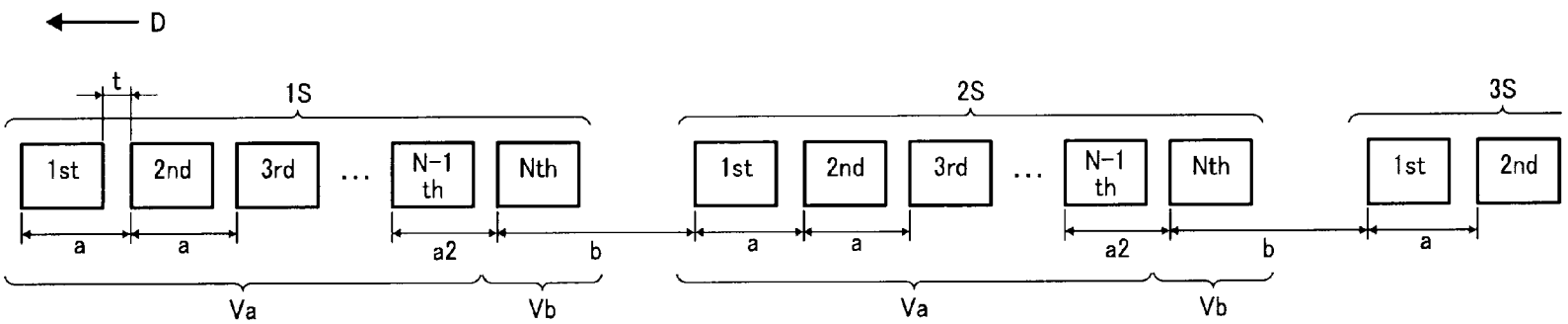
FIG. 4 is an illustration for explaining operation of sequentially transferring a plurality of recording sheets subjected for saddle-stitching, performed by the image forming apparatus of FIG. 1.

Referring now to FIG. 4, operation of sequentially creating a plurality of book documents is explained according to an example embodiment of the present invention. More specifically, in FIG. 4, an order of and a distance between recording sheets that are transferred through the fixing device 14 of the image forming apparatus 1 before being output to the post-processing apparatus 17 are explained. In this example, it is assumed that the image forming apparatus 1 receives a user instruction for creating a plurality of book documents each including a set of recording sheets, for example, through an operation device.

The image forming apparatus 1 transfers a set of recording sheets including a first page, a second page, a third page, a (N−1)th page, and an Nth page, which is to be stapled together to create a first book document 1S, one by one, through the fixing device 14. The image forming apparatus 1 then transfers a set of recording sheets including a first page, a second page, a third page, a (N−1)th page, and an Nth page, which is to be stapled together to create a second book document 2S, one by one, through the fixing device 14. This operation of transferring a set of recording sheets is sequentially performed for a number of book documents to be created. In FIG. 4, the arrow D indicates an order in which a plurality of recording sheets is transferred, one by one, from the secondary transfer nip through the fixing device 14 before being output to the post-processing apparatus 17.

In such case, the distance between the leading edge of the preceding page and the leading edge of the succeeding page within one set of recording sheets to be stapled into one book document is referred to as a reference distance a. The reference distance a is determined based on the printing speed of the image forming apparatus 1. For example, assuming that the image forming apparatus 1 is capable of printing 60 pages per 1 minute, the printing speed is expressed as 60 ppm. In such case, the reference distance a is determined as one second.

The distance between two book documents, which is the distance between the leading edge of the last page N of the preceding book document and the leading edge of the first page of the succeeding book document is referred to as a first distance b. The first distance b is determined based on a time required for post-processing to be performed by the post-processing apparatus 17 such as stapling or folding. The first distance b is set to have a value equal to or greater than the value of the reference distance a. This prevents the first recording sheet of the succeeding book document to be transferred to the post-processing apparatus 17 while the post-processing apparatus 17 is performing post-processing to the preceding book document.

In this example, the sheet transfer speed of the recording sheet other than the last page of the book document (the first page up to the (N−1)th page) is transferred at a reference linear speed Va. The reference linear speed Va is determined based on the trade-off between the image quality such as gloss or color and the productivity such as the processing speed. For example, the reference linear speed Va is set as the highest level of the sheet transfer speed that sufficiently fixes the toner image without considering post-processing that may be applied to the recording sheet after toner is fixed.

The sheet transfer speed of the last page (Nth page) of the book document is transferred at a second linear speed Vb. The second linear speed Vb is determined so as to have a value less than the value of the reference linear speed Va. Since the reference linear speed Va is determined without considering post-processing that may be applied to the recording sheet, the toner image of the recording sheet that is fixed at the reference linear speed Va may be partially removed especially when post-processing such as folding is applied. In case of a book document, such removal of toner may not be recognized if the recording sheet is placed at the inner side of the book document but will be recognized if the recording sheet is placed at the outer surface of the book document. In order to keep the appearance of the book document in good quality while keeping the relatively high processing speed, the image forming apparatus 1 transfers the last page of the book document to the fixing device 14 at the second linear speed Vb having a value less than the value of the reference linear speed Va. With the reduced linear speed Vb, the Nth recording sheet, which is the last page of the book document, receives more heat and pressure from the fixing device 14 as it is transferred through the fixing device 14. Accordingly, the toner image is sufficiently fixed so as to suppress the toner image from being partially removed even when post-processing such as folding is applied. With this function, the book document that is created is kept in good quality as the recording sheet placed outside of the book document is kept in good quality. Further, since the recording sheet other than the last page of the book document is transferred at the reference linear speed Va, the processing speed of the image forming apparatus 1 is kept relatively at the high processing speed, thus keeping the productivity high.

After the Nth recording sheet, which is the last page of the book document, is transferred, the transfer speed of the recording sheet that is transferred through the fixing device 14 is changed from the second linear speed Vb back to the reference linear speed Va to prepare for next book document. In this case, when the distance between the Nth recording sheet of the preceding set of recording sheets and the first page of the succeeding set of recording sheets is too short, the leading edge of the first page of the succeeding set of recording sheets that is transferred at the reference linear speed Va may be made in contact with the trailing edge of the last page of the preceding set of recording sheets that is transferred at the second linear speed Vb. The first distance b between the leading edge of the Nth recording sheet of the preceding set of recording sheets and the leading edge of the first recording sheet of the succeeding set of recording sheets is determined based on a time it required for the post-processing apparatus 17 to perform post-processing such as saddle-stitching and the second linear speed Vb of the Nth recording sheet of the preceding set of recording sheets that are transferred through the fixing device 14.

Further, as illustrated in FIG. 4, the distance between the leading edge of the (N−1)th recording sheet and the leading edge of the Nth recording sheet in the same set of recording sheets is referred to as a second distance a2. The second distance a2 may be determined so as to have a value greater than the value of the reference distance a. Assuming that the second distance a2 is set to have a value equal to the value of the reference distance a, the image forming apparatus 1 may not be able to change the linear speed at the fixing device 14 from the reference linear speed Va to the second linear speed Vb within a time period between the time when the trailing edge of the (N−1)th recording sheet is transferred through the fixing nip and the time when the leading edge of the Nth recording sheet enters the fixing nip. By setting the second distance a2 to have a value greater than the reference distance a, the image forming apparatus 1 has more time in changing the value of the linear speed. When the image forming apparatus 1 is able to change the linear speed at the fixing device 14 from the reference linear speed Va to the second linear speed Vb within the above-described time period, the second distance a2 may be set to have the value equal to the value of the reference distance a.

In case when the distance between the secondary transfer nip and the fixing nip is less than the length of the recording sheet in the sheet transfer direction, the image forming apparatus 1 may change the linear speed of the recording sheet at the transfer belt 9 from the reference linear speed Va to the second linear speed Vb in addition to changing the linear speed at which the recording sheet is transferred through the fixing device 14.

Figure 5:
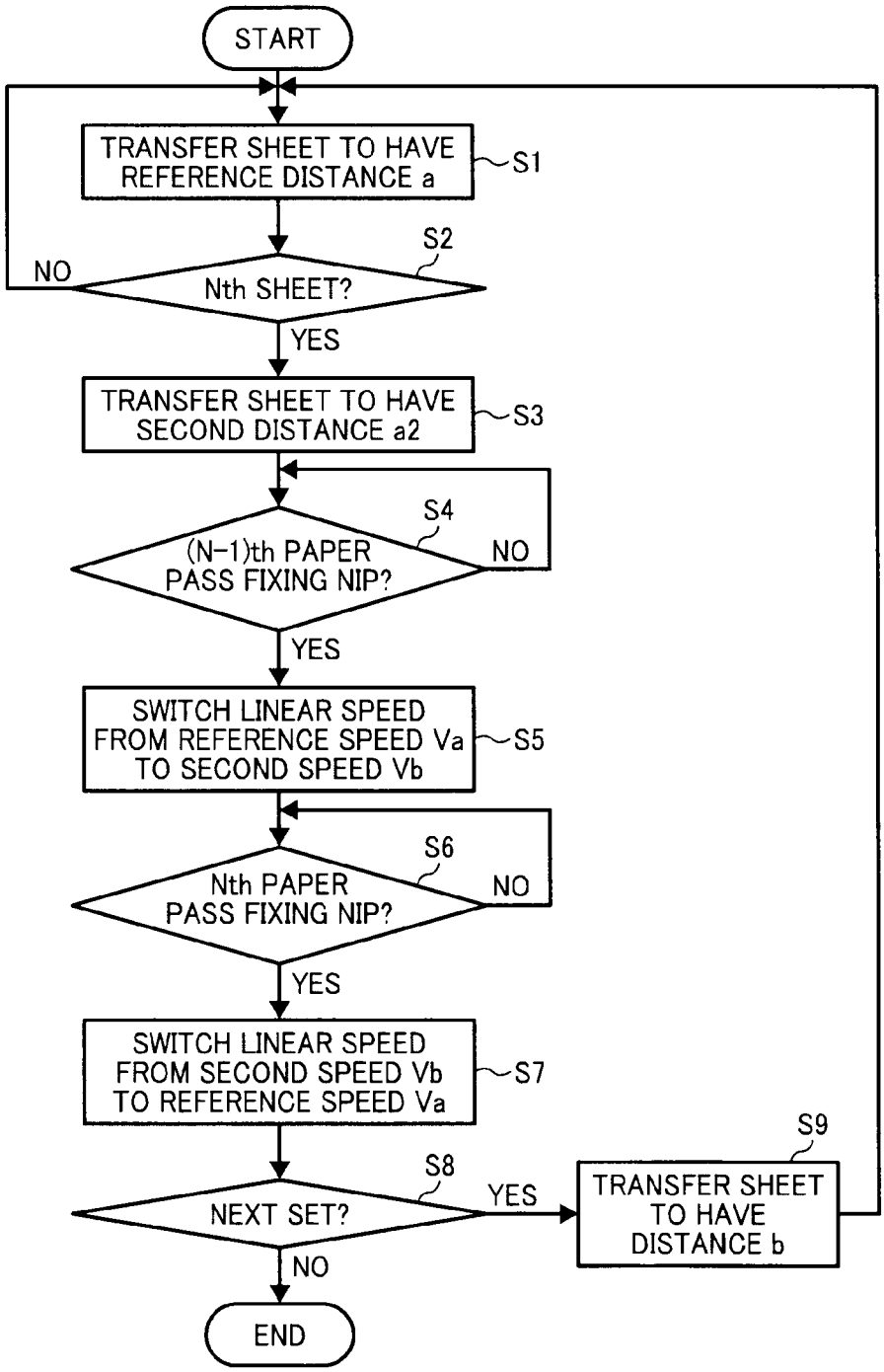
FIG. 5 is a flowchart illustrating operation of controlling transfer speeds of a plurality of recording sheets to be bundled together to create a book document, performed by the image forming apparatus of FIG. 1.

Referring now to FIG. 5, operation of controlling the linear speed and the distance is explained according to an example embodiment of the present invention. The operation of FIG. 5 may be performed by the controller 100 of the image forming apparatus 1 when the controller 100 is instructed to perform operation of outputting a plurality of recording sheets to be bundled as a book document. More specifically, when the image forming apparatus 1 receives an instruction for printing a plurality of recording sheets to be bundled as a book document, the CPU 101 performs the operation of FIG. 5 according to the image forming control program stored in the ROM 102.

At S1, the controller 100 transfers the recoding sheet 12 from the sheet feeding device 11 at a timing such that the distance between the preceding recording sheet and the succeeding recording sheet is set at a reference distance a. In order to control the value of the distance, the controller 100 controls the sheet transfer motor 105 to transfer the recording sheet while keeping the reference distance a.

At S2, the controller 100 determines whether the recording sheet to be fed from the sheet feeding device 11 is the Nth recording sheet, or the last page, of the set of recording sheets to be bundled as one book document. In this example, the controller 100 is provided with a counter, which counts an accumulated number of recording sheets that are transferred from the sheet feeding device 11 to output a counted value. At S2, when the counted value reaches the value (N−1), the controller 100 determines that the Nth recording sheet is to be fed from the sheet feeding device 11, and the operation proceeds to S3. When the counted value does not reach the value (N−1), the controller 100 determines that the recording sheet to be fed from the sheet feeding device 11 is not the Nth recording sheet ("NO" at S2), and the operation returns to S1.

At S3, the controller 100 transfers the Nth recording sheet, which is the last page of the set of recording sheets, at a timing such that the distance between the (N−1)th recording sheet and the Nth recording sheet is set at a second distance a2. In addition to changing the timing at which the Nth recording sheet is fed from the sheet feeding device 11, the controller 100 controls the timing at which image formation is started, for example, through controlling outputting of an image forming start signal, such that the Nth recording sheet receives an image at the secondary nip position. In alternative to changing the timing at which the recording sheet is fed from the sheet feeding device 11, the controller 100 may cause the registration roller pair to transfer the Nth recording sheet at the timing such that the distance between the (N−1)th recording sheet and the Nth recording sheet is set at a second distance a2.

At S4, the controller 100 determines whether the trailing edge of the (N−1)th recording sheet passes the fixing nip at the fixing device 14 based on a detection result output by a sheet detection sensor that is provided at the fixing nip. In this example, the sheet detection sensor outputs a detection result indicating that the recording sheet exits the fixing nip as the trailing edge of the recording sheet exits the fixing nip. When it is determined that the trailing edge of the (N−1)th recording sheet passes the fixing nip ("YES" at S4), the operation proceeds to S5. Otherwise, the operation repeats S4.

At S5, the controller 100 changes the linear speed at which the recording sheet is transferred through the fixing device 14 from the reference linear speed Va to the second linear speed Vb.

At S6, the controller 100 determines whether the trailing edge of the Nth recording sheet passes the fixing nip at the fixing device 14 based on a detection result output by the sheet detection sensor. When it is determined that the trailing edge of the Nth recording sheet passes the fixing nip ("YES" at S6), the operation proceeds to S7. Otherwise, the operation repeats S6.

At S7, the controller 100 changes the linear speed at which the recording sheet is transferred through the fixing device 14 from the second linear speed Vb back to the reference linear speed Va.

At S8, the controller 100 determines whether there is another set of recording sheets to be bundled as another book document, for example, according to information regarding a job to be performed. When it is determined that there is another set of recording sheets to be processed ("YES" at S8), the operation proceeds to S9. When it is determined that there is no set of recording sheets to be processed ("NO" at S8), the operation ends.

At S9, the controller 100 transfers the recording sheet 12 from the sheet feeding device 11 at the timing such that the distance between the Nth recording sheet of the set of recording sheets being processed and the first page of a next set of recording sheets to be processed is set at the first distance b. For the next set of recording sheets, S1 to S8 are repeated in a substantially similar manner as described above referring to FIG. 5.

The above-described operation of controlling the linear speed and the distance may be performed in various other ways. For example, in the above-described example, the Nth recording sheet, which is the last page, of the set of recording sheets to be bundled as one book document is placed onto the outer surface of the book document. Alternatively, the first recording sheet, which is the first page, of the set of recording sheets to be bundled as one book document may be placed onto the outer surface of the book document. In such case, the linear speed at which the first recording sheet is transferred through the fixing device 14 is set to have the second linear speed Vb.

Further, the linear speed at which the Nth recording sheet or the first recording sheet passes the fixing nip at the fixing device 14 may be determined based on characteristics of the Nth or first recording sheet such as the thickness or type of the recording sheet. The characteristics of the recording sheet may be determined, for example, based on information received from a user. For example, at the time of setting the recording sheet 12 onto the sheet feeding device 11, the user may input various information regarding characteristics of the recording sheet such as the thickness or type. Such information regarding the characteristics of the recording sheet may be stored in a memory such as a non-volatile memory of the image forming apparatus 1. When transferring the Nth or first recording sheet from the sheet feeding device 11, the controller 100 may read out such information regarding the characteristics of the recording sheet from the memory. Alternatively, the fixing device 14 may be provided with a thickness detection sensor capable of detecting the thickness of the recording sheet, at the position upstream of the fixing nip in the sheet transfer direction. Based on a detection result of the thickness detection sensor, the controller 100 may determine the linear speed Vb of the first or Nth recording sheet that passes the fixing nip. Since the linear speed Vb is determined based on characteristics of the recording sheet, the recording sheet is sufficiently heated such that the toner image formed thereon is fixed onto the recording sheet. Further, the productivity such as the processing speed may be kept relatively high.

For example, in case when the first or Nth recording sheet is thin paper, the controller 100 may determine to keep the value of linear speed at the reference linear speed Va as the first or Nth recording sheet is able to receive the heat that sufficiently fixes the toner image even when the linear speed is not changed.

Further, in this example, information regarding the value of the reference linear speed Va, the value of the second linear speed Vb, the value of the reference distance a, the value of the first distance b, and the value of the second distance a2 may be stored in the memory 103. Further, any one of the values stored in the memory 103 may be modified, for example, based on various characteristics of the image forming apparatus 1 or the recording sheet.

Figure 6:
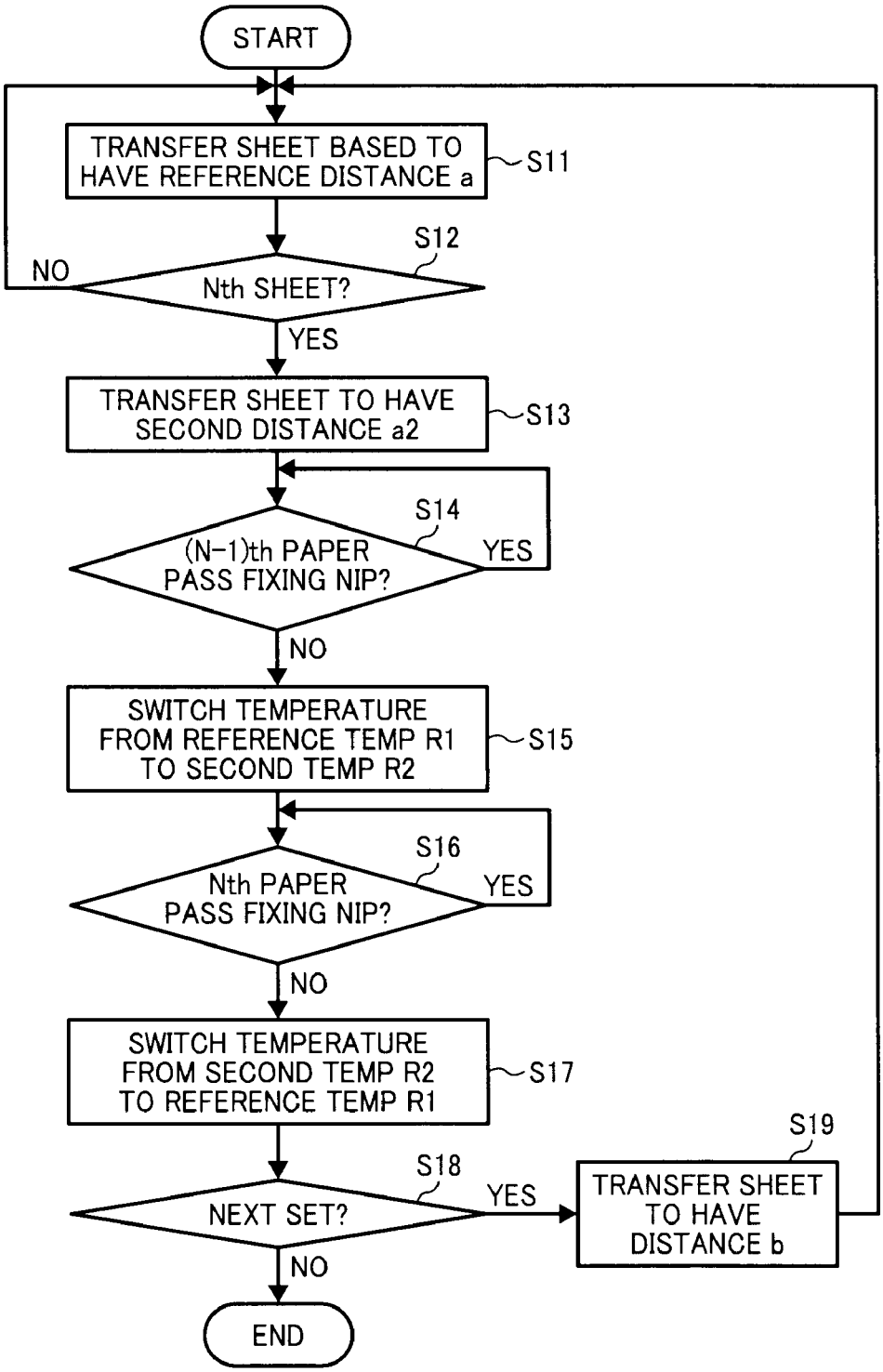
FIG. 6 is a flowchart illustrating operation of controlling fixing temperatures of a plurality of recording sheets to be bundled together to create a book document, performed by the image forming apparatus of FIG. 1.

Referring now to FIG. 6, operation of controlling the fixing temperature and the distance, performed by the image forming apparatus 1, is explained according to an example embodiment of the present invention. The operation of FIG. 6 may be performed by the controller 100 of the image forming apparatus 1 when the controller 100 is instructed to perform operation of outputting a plurality of recording sheets to be bundled as a book document. More specifically, when the image forming apparatus 1 receives an instruction for printing a plurality of recording sheets to be bundled as a book document, the CPU 101 performs the operation of FIG. 5 according to the image forming control program stored in the ROM 102.

In the above-described example, the linear speed for transferring the first or Nth recording sheet is made lower so as to allow the first or the Nth recording sheet to be transferred through the fixing device 14 at a longer period of time that sufficiently fixes the toner image formed thereon. Alternatively, in this example, the fixing temperature is made higher so as to increase the amount of heat that is applied to the first or Nth recording sheet, thus causing the toner image to be sufficiently fixed onto the first or Nth recording sheet.

Referring to FIG. 6, at S11, the controller 100 transfers the recoding sheet 12 from the sheet feeding device 11 at a timing such that the distance between the preceding recording sheet and the succeeding recording sheet is set at a reference distance a. For the first to the (N−1)th recording sheet, the fixing device 14 fixes the toner image at a reference fixing temperature R1.

At S12, the controller 100 determines whether the recording sheet to be fed from the sheet feeding device 11 is the Nth recording sheet, or the last page, of the set of recording sheets in a substantially similar manner as described above referring to S2 of FIG. 5. When the controller 100 determines that the Nth recording sheet is to be fed from the sheet feeding device 11, the operation proceeds to S13. Otherwise, operation repeats S11.

At S13, the controller 100 transfers the Nth recording sheet at a timing such that the distance between the (N−1)th recording sheet and the Nth recording sheet is set at a second distance a2 in a substantially similar manner as described above referring to S3 of FIG. 5.

At S14, the controller 100 determines whether the trailing edge of the (N−1)th recording sheet passes the fixing nip at the fixing device 14 based on a detection result output by the sheet detection sensor that is provided at the fixing nip in a substantially similar manner as described above referring to S4 of FIG. 5. When it is determined that the trailing edge of the (N−1)th recording sheet passes the fixing nip ("YES" at S14), the operation proceeds to S15. Otherwise, operation repeats S14.

At S15, the controller 100 changes the fixing temperature, which is the heating temperature of the heating source 14*c*, from the reference fixing temperature R1 to a second fixing temperature R2. In this example, the second fixing temperature R2 is set to have a value greater than the value of the reference fixing temperature R1.

At S16, the controller 100 determines whether the trailing edge of the Nth recording sheet passes the fixing nip at the fixing device 14 based on a detection result output by the sheet detection sensor. When it is determined that the trailing edge of the Nth recording sheet passes the fixing nip ("YES" at S16), the operation proceeds to S17. Otherwise, the operation repeats S16.

At S17, the controller 100 changes the fixing temperature of the fixing device 14 from the second fixing temperature R2 back to the reference fixing temperature R1.

At S18, the controller 100 determines whether there is another set of recording sheets to be bundled as another book document. When it is determined that there is another set of recording sheets to be processed ("YES" at S18), the operation proceeds to S19. When it is determined that there is no set of recording sheets to be processed ("NO" at S18), the operation ends.

At S19, the controller 100 transfers the recording sheet 12 from the sheet feeding device 11 at the timing such that the distance between the Nth recording sheet of the set of recording sheets being processed and the first page of a next set of recording sheets to be processed is set at the first distance b. For the next set of recording sheets, S11 to S18 are repeated in a substantially similar manner as described above referring to FIG. 6.

In this example, the second distance a2 is set based on a time period which requires the fixing temperature of the fixing device 14 to increase from the reference fixing temperature R1 to the second fixing temperature R2. For most of cases, the fixing device 14 requires a relatively long time to heat up from the reference fixing temperature R1 to the second fixing temperature R2. Accordingly, the second distance a2 has a value greater than the value of the reference distance a. Further, in this example, the first distance b is set based on either one of a time period which requires the fixing temperature of the fixing device 14 to decrease from the second fixing temperature R2 to the reference fixing temperature R1 and a time period which requires the post-processing apparatus 17 to complete creation of a book document. More specifically, the time period required for changing the fixing temperature is compared with the time period required for performing post-processing, and the longer time period is used for determining the value of the first distance b.

As described above referring to FIG. 6, in this example, the amount of heat applied to the Nth recording sheet increases as the fixing temperature applied to the Nth recording sheet that is transferred through the fixing device 14 is made higher than the reference fixing temperature. This causes the toner image to be sufficiently fixed onto the Nth recording sheet, thus preventing the toner image from being partially removed from the Nth recording sheet even when post-processing such as folding is applied to the Nth recording sheet that is to be placed onto the outer surface of the book document. In this manner, the book document is kept in good quality. Further, since the recording sheets other than the Nth recording sheet, which are to be placed onto the inner side of the book document, are heated with the reference fixing temperature R1, the productivity such as the processing speed or the energy conservation is kept at relatively high level. In this example, the linear speed is kept at the reference linear speed Va for all recording sheets.

In alternative to changing the fixing temperature of the fixing device 14 through controlling the heating temperature of the heating source 14*c*, the amount of heat may be increased by additionally providing a secondary heat source in the pressure roller 14*b*. When the Nth recording sheet to be placed onto the outer surface of the book document is transferred through the fixing device 14, the secondary heat source may be turned on. In this manner, the Nth recording sheet is heated by the heat source 14*c* of the fixing roller 14*a* and the secondary heat source of the pressure roller 14*b*. This increases the amount of heat applied to the Nth recoding sheet per a unit time.

Further, in this example, the value of the second fixing temperature R2 may be determined based on characteristics of the Nth recording sheet such as the thickness or type of the Nth recording sheet. The characteristics of the Nth recording sheet may be determined in a substantially similar manner as described above referring to FIG. 5. By determining the value of the second fixing temperature R2 based on the characteristics of the Nth recording sheet, degradation in image quality such as gloss or color may be suppressed. Further, the fixing temperature may be kept the same depending on the characteristics of the Nth recording sheet.

Further, in this example, information regarding the value of the reference fixing temperature R1, the value of the second fixing temperature R2, the value of the reference distance a, the value of the first distance b, and the value of the second distance a2 may be stored in the memory 103. Further, any one of the values stored in the memory 103 may be modified, for example, based on various characteristics of the image forming apparatus 1 or the recording sheet.

Figure 7:
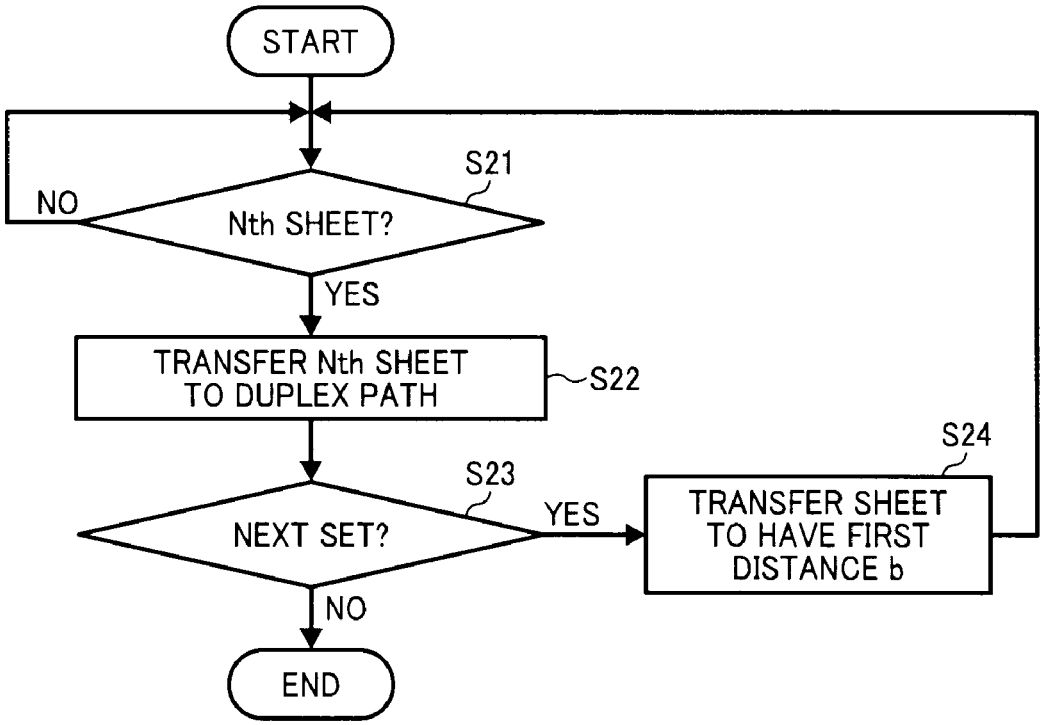
FIG. 7 is a flowchart illustrating operation of controlling a time period for heating a plurality of recording sheets to be bundled together to create a book document, performed by the image forming apparatus of FIG. 1

Referring to FIG. 7, operation of controlling transfer of the recording sheet, performed by the image forming apparatus 1, is explained according to an example embodiment of the present invention. The operation of FIG. 7 may be performed by the controller 100 of the image forming apparatus 1 when the controller 100 is instructed to perform operation of outputting a plurality of recording sheets to be bundled as a book document. More specifically, when the image forming apparatus 1 receives an instruction for printing a plurality of recording sheets to be bundled as a book document, the CPU 101 performs the operation of FIG. 7 according to the image forming control program stored in the ROM 102. In this example, the first or Nth recording sheet to be placed onto the outer surface of the book document is caused to pass the fixing nip twice.

In this example, the controller 100 transfers the recoding sheet 12 from the sheet feeding device 11 at a timing such that the distance between the preceding recording sheet and the succeeding recording sheet is set at a reference distance a. Further, the recording sheet is transferred at the reference linear speed Va. For the first to (N−1)th recording sheets, the recording sheet that is transferred through the fixing device 14 is transferred to the post-processing apparatus 17.

At S21, the controller 100 determines whether the recording sheet to be fed from the sheet feeding device 11 is the Nth recording sheet, or the last page, of the set of recording sheets in a substantially similar manner as described above referring to S2 of FIG. 5. When the controller 100 determines that the Nth recording sheet is to be fed from the sheet feeding device 21, the operation proceeds to S22. Otherwise, the operation repeats S21.

At S22, the controller 100 causes the Nth recording sheet that exits the fixing device 14 to be transferred to the switch back device 15. After the Nth recording sheet is reversed at the switch back device 15, the Nth recording sheet is further transferred to the duplex transfer path 16. The Nth recording sheet is then transferred to the secondary transfer device 10. Without receiving any image at the secondary transfer device 10, the Nth recording sheet is transferred to the fixing device 14 for fixing operation again. The Nth recording sheet that exits the fixing device 14 is output to the post-processing apparatus 17.

At S23, the controller 100 determines whether there is another set of recording sheets to be bundled as another book document. When it is determined that there is another set of recording sheets to be processed ("YES" at S23), the operation proceeds to S24. When it is determined that there is no set of recording sheets to be processed ("NO" at S23), the operation ends.

At S24, the controller 100 transfers the recording sheet 12 from the sheet feeding device 11 at the timing such that the distance between the Nth recording sheet of the set of recording sheets being processed and the first page of a next set of recording sheets to be processed is set at the first distance b. For the next set of recording sheets, S21 to S23 are repeated in a substantially similar manner as described above referring to FIG. 7.

In this example, the first or Nth recording sheet to be placed onto the outer surface of the book document is caused to be transferred through the fixing device 14 twice or a plurality of number of times, thus increasing the overall heating time period at which the first or Nth recording sheet is heated. Since the toner image is sufficiently fixed onto the first or Nth recording sheet, the toner image is prevented from being partially removed from the recording sheet even when post-processing such as folding is applied. The book document is thus kept in good quality. Further, since the recording sheets that are placed at inner side of the book document is processed with the reference linear speed Va or with the reference fixing temperature R1, the productivity is kept at relatively high level.

In this example, the value of the first distance b is determined based on a time period which requires for the Nth recording sheet to return to the fixing device 14 so as to prevent the first recording sheet of a next set of recording sheets from reaching the Nth recording sheet.

Further, in this example, the number of times the first or Nth recording sheet is transferred through the fixing device 14 may be determined based on characteristics of the first or Nth recording sheet. The characteristics of the recording sheet may be determined in a substantially similar manner as described above referring to FIG. 5. By determining the number of times the first or Nth recording sheet is transferred through the fixing device 14 based on the characteristics of the recording sheet, the toner image may be fixed with the amount of heat that sufficiently fixes the toner image that suppresses the toner image to be partially removed even when post-processing is applied. Further, the number of times the first or Nth recording sheet is transferred through the fixing device 14 may be set depending on the characteristics of the first or Nth recording sheet.

Any one of the above-described methods of FIGS. 5, 6, and 7 may be combined with each other and/or substituted for each other to control the amount of heat to be applied to a recording sheet that is to be placed on the outer surface of the book document. For example, when the Nth recording sheet is detected, the controller 100 increases the fixing temperature to increase from the reference fixing temperature R1 to the second fixing temperature R2, and switches the linear speed at which the Nth recording sheet is transferred through the fixing device 14 from the reference linear speed Va to the second reference linear speed Vb. Accordingly, the amount of heat applied to the Nth recording sheet increases. In another example, when the Nth recording sheet is detected, the controller 100 may change all of the linear speed, the fixing temperature, and a number of times the Nth recording sheet is transferred through the fixing device 14 to increase the amount of heat applied to the Nth recording sheet. Alternatively, the controller 100 may change a width of the fixing nip through which the Nth recording sheet is transferred to be greater than a width of the fixing nip through which the other recording sheets are transferred. With the increased fixing nip width, the amount of heat applied to the Nth recording sheet increases to sufficiently fix the toner image formed thereon.

In the above-described examples, the post-processing apparatus 17 is assumed to perform saddle-stitching to create a book document. Alternatively, the post-processing apparatus 17 may apply paper-back binding to create a book document.

Figure 8:
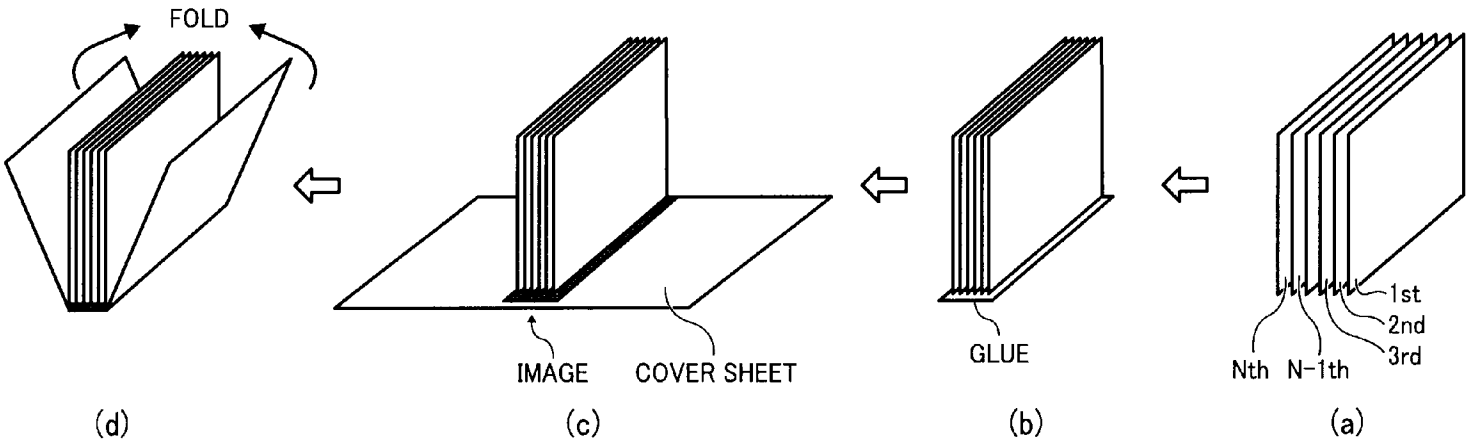
FIG. 8 is an illustration for explaining operation of creating a book document by paper-back binding.

Referring to FIG. 8, operation of creating a book document by paper-back binding, performed by the post-processing apparatus 17, is explained according to an example embodiment of the present invention.

The post-processing apparatus 17 receives a set of recording sheets from the image forming apparatus 1, and mounts the set of recording sheets onto a collection tray as illustrated in FIG. 8(*a*). When it is determined that all pages of the recording sheets to be bundled as a book document is mounted onto the collection tray, as illustrated in FIG. 8(*b*), a side section of the sheet bundle of the recording sheets is applied with glue. After the side section of the sheet bundle is glued, the post-processing apparatus 17 receives a cover sheet having a size slightly larger than the size of the recording sheets 12 of the sheet bundle, from the image forming apparatus 1. The cover sheet is transferred to the post-processing apparatus 17 while the side having the image formed thereon faces down. As illustrated in FIG. 8(*c*), a center section of the cover sheet is glued together with the glued side section of the sheet bundle of recording sheets. As illustrated in FIG. 8(*d*), the cover sheet is folded to generate a book document.

Since the cover sheet that is placed onto the outer surface of the book document is folded, the toner image formed on the cover sheet may be partially removed unless the toner image is sufficiently fixed. In order to prevent the toner image from being partially removed from the cover sheet, the cover sheet may be processed by the image forming apparatus 1 in a substantially similar manner as processing performed on the first or Nth recording sheet of a set of recording sheets to be bundled as one book document. For example, the amount of heat applied to the cover sheet at the fixing device 14 may be caused to increase.

Figure 9:
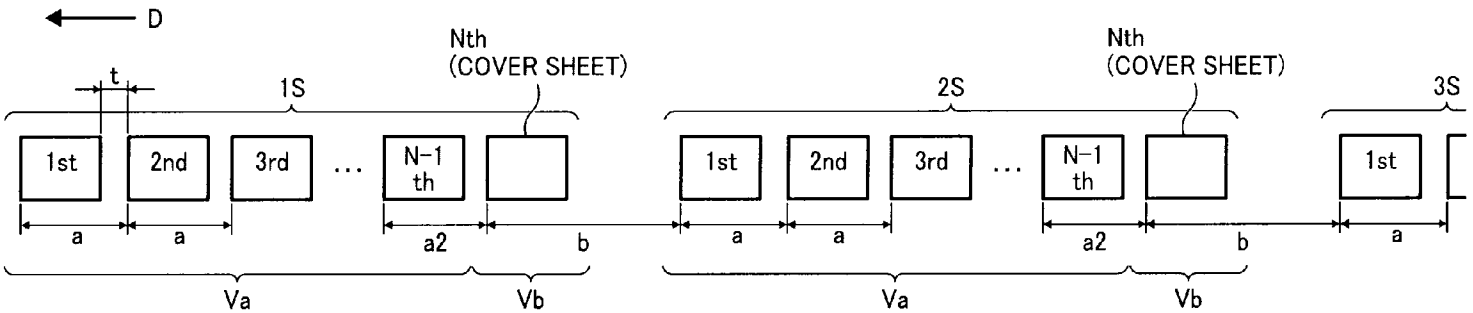
FIG. 9 an illustration for explaining operation of sequentially transferring a plurality of recording sheets subjected for paper-back binding, performed by the image forming apparatus of FIG. 1.

Referring to FIG. 9, operation of sequentially creating a plurality of book documents is explained according to an example embodiment of the present invention. More specifically, in FIG. 9, an order of recording sheets and a distance between recording sheets that are transferred through the fixing device 14 of the image forming apparatus 1 before being output to the post-processing apparatus 17 are explained. In this example, it is assumed that the image forming apparatus 1 receives a user instruction for creating a plurality of book documents each including a set of recording sheets, for example, through an operation device.

The image forming apparatus 1 transfers a set of recording sheets including a first page, a second page, a third page, a (N−1)th page, and an Nth page, which is to be glued together to create a first book document 1S, one by one, through the fixing device 14. The image forming apparatus 1 then transfers a set of recording sheets including a first page, a second page, a third page, a (N−1)th page, and an Nth page, which is to be glued together to create a second book document 2S, one by one, through the fixing device 14. This operation of transferring a set of recording sheets is sequentially performed for a number of book documents to be created. In FIG. 9, the arrow D indicates an order in which a plurality of recording sheets is transferred, one by one, from the secondary transfer nip through the fixing device 14 before being output to the post-processing apparatus 17.

Further, in this case of creating a book document by paper-back binding, the Nth recording sheet to be placed at the outer surface of the book document, or the cover sheet, has a sheet size slightly greater than the sheet size of the other recording sheets of the book document.

The distance between the leading edge of the preceding page and the leading edge of the succeeding page within one set of recording sheets to be glued into one book document is referred to as a reference distance a. The reference distance a is determined based on the printing speed of the image forming apparatus 1 as described above referring to FIG. 4.

The distance between two book documents, which is the distance between the leading edge of the last page N of the preceding book document and the leading edge of the first page of the succeeding book document is referred to as a first distance b. The first distance b is determined based on a time required for post-processing to be performed by the post-processing apparatus 17 such as applying glue or folding. The first distance b is set to have a value equal to or greater than the value of the reference distance a.

As described above referring to any one of FIGS. 5, 6, and 7, the amount of heat applied to the Nth recording sheet which is the cover sheet may be controlled in various ways. In one example, the controller 100 switches the linear speed at which the Nth recording sheet is transferred through the fixing device 14 from the reference linear speed V1 to the secondary linear speed V2, with the linear speed V1 being greater than the linear speed V2. In another example, the controller 100 changes the fixing temperature of the fixing device 14 from the reference fixing temperature R1 to the second fixing temperature R2, with the second fixing temperature R2 being greater than the reference fixing temperature R1. In another example, the controller 100 causes the Nth recording sheet to be transferred through the fixing device 14 more than one time to increase the amount of heat applied to the Nth recording sheet.

Further, the controller 100 may determine any one of the linear speed, the fixing temperature, and a number of times the recording sheet is transferred through the fixing device 14, depending on characteristics of the Nth recording sheet such as the thickness or the type of the Nth recording sheet. For example, the controller 100 may determine whether to switch the linear speed from the reference linear speed Va to the second linear speed Vb based on characteristics of the Nth recording sheet. In another example, the controller 100 may determine the value of the second linear speed Vb based on characteristics of the Nth recording sheet. In another example, the controller 100 may determine whether to switch the fixing temperature from the reference fixing temperature R1 to the second fixing temperature R2 based on characteristics of the Nth recording sheet. In another example, the controller 100 may determine the value of the second fixing temperature R2 based on characteristics of the Nth recording sheet. In another example, the controller 100 may determine whether to transfer the Nth recording sheet that has been transferred through the fixing device 14 back to the fixing device 14 based on characteristics of the Nth recording sheet. In another example, the controller 100 may determine a number of times the Nth recording sheet is transferred through the fixing device 14 based on characteristics of the Nth recording sheet.

As described above, in one example, an image forming system includes an image forming apparatus and a post-processing apparatus. The image forming apparatus includes a fixing device that fixed an unfixed toner image onto a recording sheet being transferred by heat. The post-processing apparatus is provided with at least one of: a function of creating a book document by saddle-stitching in which a plurality of recording sheets is bundled, stapled and folded; and a function of creating a book document by paper-back binding in which a plurality of recording sheets is bundled, folded, and glued onto a cover sheet. The cover sheet has a sheet size that is slightly greater than the sheet size of each of the plurality of recording sheets of the sheet bundle. When glued, the cover sheet is placed at an outer surface of the sheet bundle. The image forming apparatus further includes a controller that controls a device of the image forming apparatus such that an amount of heat applied by the fixing device onto a outer surface recording sheet of the sheet bundle, which is placed at an outer surface of the book document, is greater than an amount of heat applied by the fixing device onto the other recording sheets of the sheet bundle.

Accordingly, a toner image is sufficiently fixed onto the outer surface recording sheet. This suppresses the toner image to be partially removed from the outer surface recording sheet even when the recording sheet is folded. Further, since installation of a heater onto the post-processing apparatus is not required, the size of the post-processing apparatus is not increased and the manufacturing cost of the post-processing apparatus is not increased.

In one example, the controller of the image forming apparatus controls the image forming apparatus such that a transfer speed at which the outer surface recording sheet is transferred through the fixing device is less than a transfer speed at which the other recording sheet is transferred through the fixing device. Accordingly, the amount of heat applied by the fixing device onto the outer surface recording sheet is greater than the amount of heat applied by the fixing device onto the other recording sheet.

In another example, the controller of the image forming apparatus controls the image forming apparatus such that a fixing temperature of the fixing device when the outer surface recording sheet is transferred through the fixing device is greater than a fixing temperature of the fixing device when the other recording sheet is transferred through the fixing device. Accordingly, the amount of heat applied by the fixing device onto the outer surface recording sheet is greater than the amount of heat applied by the fixing device onto the other recording sheet.

In another example, the controller of the image forming apparatus controls the image forming apparatus such that a umber of times that outer surface recording sheet is transferred through the fixing device is greater than a number of times the other recording sheet is transferred through the fixing device. Accordingly, the amount of heat applied by the fixing device onto the outer surface recording sheet is greater than the amount of heat applied by the fixing device onto the other recording sheet.

In another example, the amount of heat supplied by the fixing device to the outer surface recording sheet may be controlled based on characteristics of the outer surface recording sheet such as the thickness or type of the outer surface recording sheet. Accordingly, the outer surface recording sheet is supplied with an amount of heat that sufficiently fixes the toner image onto the outer surface recording sheet even when the type or thickness of the outer surface recording sheet varies. This suppresses the toner image from being partially removed from the outer surface recording sheet even when the outer surface recording sheet is folded. Further, since installation of a heater onto the post-processing apparatus is not required, the size of the post-processing apparatus is not increased and the manufacturing cost of the post-processing apparatus is not increased. Further, this suppresses the image forming apparatus to supply an excessive amount of heat to the outer surface recording sheet, thus suppressing image degradation in the resultant image. Thus, gloss or color reproducibility of the toner image is kept relatively high.

In another example, the controller of the image forming apparatus may control a transfer speed at which the outer surface recording sheet is transferred through the fixing device based on the thickness or type of the outer surface recording sheet. Accordingly, the amount of heat is controlled based on the thickness or type of the outer surface recording sheet.

In another example, the controller of the image forming apparatus may control a fixing temperature of the fixing device when the outer surface recording sheet is transferred through the fixing device based on the thickness or type of the outer surface recording sheet. Accordingly, the amount of heat is controlled based on the thickness or type of the outer surface recording sheet.

In another example, the controller of the image forming apparatus may control a number of times the outer surface recording sheet is transferred through the fixing device based on the thickness or type of the outer surface recording sheet. Accordingly, the amount of heat is controlled based on the thickness or type of the outer surface recording sheet.

In another example, a second distance a2 between the outer surface recording sheet and a recording sheet that precedes the outer surface recording sheet is made greater than a reference distance a between two of the recording sheets that are placed inner side of the book document.

In case of controlling the image forming apparatus such that the transfer speed at which the outer surface recording sheet is transferred through the fixing device is less than the transfer speed at which the other recording sheet is transferred, the second distance a2 is determined based on a time period between the time at which the preceding recording sheet that precedes the outer surface recording sheet exits the fixing device and the time at which the outer surface recording sheet enters the fixing device. During the time period corresponding to the second distance a2, the controller of the image forming apparatus switches the transfer speed, for example, through sending an instruction to the transfer device, from a reference transfer speed Va to a second transfer speed Vb. The outer surface recording sheet is transferred through the fixing device at the second transfer speed Vb having a value less than the value of the reference transfer speed Va. Accordingly, the amount of heat that sufficiently fixes the toner image onto the outer surface recording sheet is supplied to the outer surface recording sheet.

In case of controlling the image forming apparatus such that the fixing temperature of the fixing device when the outer surface recording sheet is transferred through the fixing device is greater than the fixing temperature of the fixing device when the other recording sheet is transferred, the second distance a2 is determined based on a time period between the time at which the preceding recording sheet that precedes the outer surface recording sheet exits the fixing device and the time at which the outer surface recording sheet enters the fixing device. During the time period corresponding to the second distance a2, the controller of the image forming apparatus switches the fixing temperature, for example, through sending an instruction to the heater source of the fixing device, from a reference fixing temperature R1 to a second fixing temperature R2. The outer surface recording sheet is transferred through the fixing device at the second fixing temperature R2 having a value greater than the value of the reference fixing temperature R1. Accordingly, the amount of heat that sufficiently fixes the toner image onto the outer surface recording sheet is supplied to the outer surface recording sheet.

A distance b between the last recording sheet of a first set of recording sheets and the first recording sheet of a second set of recording sheets is set to have a value greater than the value of the reference distance a between two recording sheets that belong to one set of recording sheets. The value of the distance b may be determined based on a timer period it required for the post-processing apparatus 17 to perform post-processing. This prevents the first recording sheet of the second set of recording sheets to be transferred to the post-processing apparatus 17 while the post-processing apparatus 17 is applying post-processing to the first set of recording sheets.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in an image forming system including: an image forming apparatus including a fixing device that fixes a toner image onto a recording sheet being transferred by applying heat to the recording sheet; and a post-processing apparatus to create a sheet bundle from a plurality of recording sheets each having a toner image fixed by the fixing device of the image forming apparatus and to create a book document either by 1) folding and stapling the sheet bundle or 2) folding the sheet bundle and covering the folded sheet bundle with a cover recording sheet that is glued to the folded sheet bundle, the cover recording sheet having a toner image formed thereon and having a sheet size greater than each of the recording sheets of the sheet bundle. The image forming apparatus further includes a controller to control at least one device of the image forming apparatus such that an amount of heat supplied at the fixing device to an outer surface recording sheet to be placed at an outer surface of the book document is greater than an amount of heat supplied at the fixing device to each of other recording sheets of the sheet bundle other than the outer surface recording sheet.

In one example, the controller of the image forming apparatus controls the at least one device of the image forming apparatus such that a transfer speed at which the outer surface recording sheet is transferred through the fixing device is less than a transfer speed at which each of the other recording sheets is transferred through the fixing device.

In one example, the controller of the image forming apparatus controls the at least one device of the image forming apparatus such that that a heating temperature of a heat source of the fixing device that is generated when the outer surface recording sheet is transferred through the fixing device is higher than a heating temperature of the heat source of the fixing device that is generated when each of the other recording sheets is transferred through the fixing device.

In one example, the controller controls the at least one device of the image forming apparatus such that a number of times the outer surface recording sheet is transferred through the fixing device is greater than a number of times each of the other recording sheets is transferred through the fixing device.

In another example, the present invention may reside in: an image forming system including: an image forming apparatus including a fixing device that fixes a toner image onto a recording sheet being transferred by applying heat to the recording sheet; and a post-processing apparatus to create a sheet bundle from a plurality of recording sheets each having a toner image fixed by the fixing device of the image forming apparatus and to create a book document either by 1) folding and stapling the sheet bundle or 2) folding the sheet bundle and covering the folded sheet bundle with a cover recording sheet that is glued to the folded sheet bundle, the cover recording sheet having a toner image formed thereon and having a sheet size greater than each of the recording sheets of the sheet bundle. The image forming apparatus further includes a controller to control at least one device of the image forming apparatus such that an amount of heat supplied at the fixing device to an outer surface recording sheet to be placed at an outer surface of the book document is changed based on a thickness or a type of the outer surface recording sheet.

In one example, the controller changes a sheet transfer speed at which the outer surface recording sheet is transferred through the fixing device based on the thickness or the type of the outer surface recording sheet.

In one example, the controller changes a heating temperature of a heat source of the fixing device that is generated when the outer surface recording sheet is transferred through the fixing device based on the thickness or the type of the outer surface recording sheet.

In one example, the controller changes a number of times the outer surface recording sheet is transferred through the fixing device based on the thickness or the type of the outer surface recording sheet.

In one example, a distance between the outer surface recording sheet and a preceding recording sheet that precedes the outer surface recording sheet is greater than a distance between two recording sheets of the other recording sheets to be placed at the inner side of the book document and that are subsequently transferred.

In one example, a first sheet bundle is created from a set of recording sheets that is firstly transferred and a second sheet bundle is created from a set of recording sheets that is subsequently transferred after the set of recording sheets of the first sheet bundle is transferred. A distance between a recording sheet that is transferred last in the first sheet bundle and a recording sheet that is transferred first in the second sheet bundle is greater than a distance between two of the recording sheets of the same sheet bundle that are subsequently transferred.

In one example, the present invention may reside in an image forming apparatus connected to a post-processing apparatus through a network. The image forming apparatus includes: a fixing device that fixes a toner image onto a recording sheet being transferred through the fixing device by applying heat to the recording sheet; and a controller to cause the post-processing apparatus to create a book document by folding a sheet bundle of a plurality of recording sheets, each of the plurality of recording sheets having a toner image formed thereon that is fixed by the fixing device. The controller controls at least one device of the image forming apparatus such that an amount of heat supplied at the fixing device to an outer surface recording sheet to be placed at an outer surface of the book document is changed based on a thickness or a type of the outer surface recording sheet.

In one example, the present invention may reside in an image forming method including: providing an image forming apparatus including a fixing device that fixes a toner image onto a recording sheet being transferred through the fixing device by applying heat to the recording sheet; and providing a post-processing apparatus connected to the image forming apparatus through a network and to create a book document by folding a sheet bundle of a plurality of recording sheets, each of the plurality of recording sheets having a toner image formed thereon that is fixed by the fixing device of the image forming apparatus; controlling at least one device of the image forming apparatus such that an amount of heat supplied at the fixing device to an outer surface recording sheet to be placed at an outer surface of the book document is greater than an amount of heat supplied at the fixing device to each of other recording sheets of the sheet bundle other than the outer surface recording sheet.

In one example, the present invention may reside in an image forming method including: providing an image forming apparatus including a fixing device that fixes a toner image onto a recording sheet being transferred through the fixing device by applying heat to the recording sheet; providing a post-processing apparatus connected to the image forming apparatus through a network and to create a book document by folding a sheet bundle of a plurality of recording sheets, each of the plurality of recording sheets having a toner image formed thereon and fixed by the fixing device of the image forming apparatus; and controlling at least one device of the image forming apparatus such that an amount of heat supplied at the fixing device to an outer surface recording sheet to be placed at an outer surface of the book document is changed based on a thickness or a type of the outer surface recording sheet.

In one example, the present invention may reside in a recording medium storing a plurality of instructions which cause a processor to perform any one of the above-described image forming methods.

What is claimed is:

1. An image forming system, comprising:

an image forming apparatus including a fixing device that fixes a toner image onto a recording sheet being transferred through the fixing device by applying heat to the recording sheet; and a post-processing apparatus connected to the image forming apparatus through a network and configured to create a book document by folding a sheet bundle of a plurality of recording sheets, each of the plurality of recording sheets having a toner image formed thereon that is fixed by the fixing device of the image forming apparatus, wherein the image forming apparatus further includes:

a controller configured to control at least one device of the image forming apparatus such that an amount of heat supplied at the fixing device to an outer surface recording sheet to be placed at an outer surface of the book document is greater than an amount of heat supplied at the fixing device to each of other recording sheets of the sheet bundle other than the outer surface recording sheet.

2. The image forming system of claim 1, wherein the controller controls the at least one device of the image forming apparatus to change a transfer speed of a recording sheet such that a transfer speed at which the outer surface recording sheet is transferred through the fixing device is less than a transfer speed at which each of the other recording sheets is transferred through the fixing device.

3. The image forming system of claim 2, wherein the controller is further configured to:

determine whether to change the transfer speed of the recording sheet based on at least one of a thickness and a type of the outer surface recording sheet; and obtain a value of the transfer speed at which the outer surface recording sheet is transferred through the fixing device using the at least one of the thickness and the type of the outer surface recording sheet when it is determined that that the transfer speed of the recording sheet should be changed.

4. The image forming system of claim 1, wherein the controller controls the at least one device of the image forming apparatus to change a fixing temperature of the fixing device such that a heating temperature of a heat source of the fixing device that is generated when the outer surface recording sheet is transferred through the fixing device is higher than a heating temperature of the heat source of the fixing device that is generated when each of the other recording sheets is transferred through the fixing device.

5. The image forming system of claim 4, wherein the controller is further configured to:

determine whether to change the fixing temperature of the fixing device based on at least one of a thickness and a type of the outer surface recording sheet; and obtain a value of the fixing temperature of the fixing device that is generated when the outer surface recording sheet is transferred through the fixing device using the at least one of the thickness and the type of the outer surface recording sheet when it is determined that the fixing temperature should be changed.

6. The image forming system of claim 1, wherein the controller controls the at least One device of the image forming apparatus such that a number of times the outer surface recording sheet is transferred through the fixing device is greater than a number of times each of the other recording sheets is transferred through the fixing device.

7. The image forming system of claim 6, wherein the controller is further configured to:

determine whether to change a number of times that outer surface recording sheet is transferred through the fixing device based on at least one of a thickness and a type of the outer surface recording sheet; and obtain a value of the number of times the outer surface recording sheet is transferred through the fixing device using the at least one of the thickness and the type of the outer surface recording sheet when it is determined that the number of times should be changed.

8. The image forming system of claim 1, wherein the controller further controls the at least one device of the image forming apparatus such that a distance between the outer surface recording sheet and a preceding recording sheet that precedes the outer surface recording sheet is greater than a distance between two successive recording sheets of the other recording sheets that are subsequently transferred.

9. The image forming system of claim 8, wherein the post-processing apparatus further creates an additional book document by folding an additional sheet bundle of an additional plurality of recording sheets that are transferred from the image forming apparatus after transfer of the plurality of recording sheets, each of the additional plurality of recording sheets having a toner image formed thereon that is fixed by the fixing device of the image forming apparatus, and the controller is further configured to control the at least one device of the image forming apparatus such that a distance between a recording sheet that is transferred last in the sheet bundle and a recording sheet that is transferred first in the additional sheet bundle is greater than a distance between two successive recording sheets of the same sheet bundle that are subsequently transferred.

10. The image forming system of claim 9, wherein the distance between the recording sheet that is transferred last in the sheet bundle and the recording sheet that is transferred first in the additional sheet bundle is greater than the distance between the outer surface recording sheet and the preceding recording sheet that precedes the outer surface recording sheet.

11. An image forming apparatus connected to a post-processing apparatus through a network, the image forming apparatus comprising:

a fixing device configured to fix a toner image onto a recording sheet being transferred through the fixing device by applying heat to the recording sheet; and a controller configured to cause the post-processing apparatus to create a book document by folding a sheet bundle of a plurality of recording sheets, each of the plurality of recording sheets having a toner image formed thereon that is fixed by the fixing device, and to control at least one device of the image forming apparatus such that an amount of heat supplied at the fixing device to an outer surface recording sheet to be placed at an outer surface of the book document is greater than an amount of heat supplied at the fixing device to each of other recording sheets of the sheet bundle other than the outer surface recording sheet.

12. The image forming apparatus of claim 11, wherein the controller controls the at least one device of the image forming apparatus to change a transfer speed of a recording sheet such that a transfer speed at which the outer surface recording sheet is transferred through the fixing device is less than a transfer speed at which each of the other recording sheets is transferred through the fixing device.

13. The image forming apparatus of claim 11, wherein the controller controls the at least one device of the image forming apparatus to change a fixing temperature of the fixing device such that a heating temperature of a heat source of the fixing device that is generated when the outer surface recording sheet is transferred through the fixing device is higher than a heating temperature of the heat source of the fixing device that is generated when each of the other recording sheets is transferred through the fixing device.

14. The image forming apparatus of claim 11, wherein the controller controls the at least one device of the image forming apparatus such that a number of times the outer surface recording sheet is transferred through the fixing device is greater than a number of times each of the other recording sheets is transferred through the fixing device.

15. The image forming apparatus of claim 11, wherein the controller further controls the at least one device of the image forming apparatus such that a distance between the outer surface recording sheet and a preceding recording sheet that precedes the outer surface recording sheet is greater than a distance between two successive recording sheets of the other recording sheets that are subsequently transferred.

16. The image forming apparatus of claim 15, wherein the controller further causes the post-processing apparatus to create an additional book document by folding an additional sheet bundle of an additional plurality of recording sheets that are transferred from the image forming apparatus after transfer of the plurality of recording sheets, each of the additional plurality of recording sheets having a toner image formed thereon that is fixed by the fixing device of the image forming apparatus, and the controller is further configured to control the at least one device of the image forming apparatus such that a distance between a recording sheet that is transferred last in the sheet bundle and a recording sheet that is transferred first in the additional sheet bundle is greater than a distance between two successive recording sheets of the same sheet bundle that are subsequently transferred.

17. An image forming system, comprising:

an image forming apparatus including a fixing device that fixes a toner image onto a recording sheet being transferred through the fixing device by applying heat to the recording sheet; and a post-processing apparatus connected to the image forming apparatus through a network and configured to create a book document by folding a sheet bundle of a plurality of recording sheets, each of the plurality of recording sheets having a toner image formed thereon that is fixed by the fixing device of the image forming apparatus, wherein the image forming apparatus further includes:

a controller configured to control at least one device of the image forming apparatus such that an amount of heat supplied at the fixing device to an outer surface recording sheet to be placed at an outer surface of the book document is changed based on at least one of a thickness and a type of the outer surface recording sheet.

18. The image forming system of claim 17, wherein the controller controls the at least one device of the image forming apparatus to change a sheet transfer speed at which the outer surface recording sheet is transferred through the fixing device based on at least one of the thickness and the type of the outer surface recording sheet.

19. The image forming system of claim 17, wherein the controller controls the at least one device of the image forming apparatus to change a heating temperature of a heat source of the fixing device that is generated when the outer surface recording sheet is transferred through the fixing device based on at least one of the thickness and the type of the outer surface recording sheet.

20. The image forming system of claim 17, wherein the controller controls the at least one device of the image forming apparatus to change a number of times the outer surface recording sheet is transferred through the fixing device based on at least one of the thickness and the type of the outer surface recording sheet.

* * * * *